United States Patent [19]

Ito et al.

[11] Patent Number: 4,926,152

[45] Date of Patent: May 15, 1990

[54] IGNITION COIL ASSEMBLY FOR INTERNAL COMBUSTION ENGINE

[75] Inventors: Shigemi Ito, Kariya; Katsunori Narita, Chiryu, both of Japan

[73] Assignee: Nippondenso Co., Ltd., Kariya, Japan

[21] Appl. No.: 404,494

[22] Filed: Sep. 8, 1989

[30] Foreign Application Priority Data

Dec. 27, 1988 [JP] Japan ..... 63-330676

[51] Int. Cl.[5] ..... H01F 27/02

[52] U.S. Cl. ..... 336/90; 336/92; 336/96; 336/98; 336/198

[58] Field of Search ..... 336/90, 92, 96, 98, 336/198, 208; 123/634

[56] References Cited

U.S. PATENT DOCUMENTS 4,099,510 7/1978 Perrier et al. ..... 336/96 X 4,763,094 8/1988 Kojima ..... 336/92

*Primary Examiner*—Thomas J. Kozma

*Attorney, Agent, or Firm*—Cushman, Darby & Cushman

[57] ABSTRACT

An ignition coil assembly for internal combustion engine has a voltage withstanding air gap of a predetermined shape and an insulating resin cover for covering the external iron core provided in addition to resin mold and partitioning wall in order to electrically insulate from the secondary coil the external iron core constituting a magnetic path together with the internal iron core.

7 Claims, 7 Drawing Sheets

IGNITION COIL ASSEMBLY FOR INTERNAL COMBUSTION ENGINE

BACKGROUND OF THE INVENTION

This invention relates to a resin-molded type ignition coil assembly for internal combustion engines (e.g., U.S. Pat. No. 4,763,094 issued on Aug. 9, 1988 and assigned to the same assignee with this invention, and particularly to one which uses a case molded integral with an external iron core.

FIG. 6 is a partial cross-sectional front view of a conventional ignition coil assembly for internal combustion engines, and FIG. 7 is a partial cross-sectional plan view taken along a line B—B in FIG. 6.

This ignition coil assembly for internal combustion engines is a resin-molded type ignition assembly for internal combustion engines which uses a case molded integral with an external iron core (hereinafter, referred to as the core-case integral-type combustion engine-purpose ignition coil assembly). This core-case integral-type combustion engine-purpose ignition coil assembly comprises a primary coil 1*a*, a secondary coil 2*a* coaxially disposed on the outside of the primary coil 1*a*, an internal iron core 3*a* inserted through the primary and secondary coils 1*a* and 2*a*, an external iron core 4*a* combined with the internal iron core 3*a* to constitute a closed magnetic path, a resin case 5*a* which is made of a resin material to be integral with the external iron core 4*a* and to have a mold space portion 50*a*, and a molded resin portion 6*a* which is formed by injecting a resin material into the mold space portion 50*a* in which the primary and secondary coils 1*a* and 2*a* and the internal iron core 3*a* are placed.

In this core-case integral-type combustion engine-purpose ignition coil assembly, a central partitioning wall portion 51*a* of the case 5*a* which separates a central portion 40*a* of the external iron core 4*a* which is parallel to the internal iron core 3*a*, from the mold space 50*a* is formed to be thick and to be in intimate contact with the central portion 40*a* of the external iron core 4*a*.

This thick wall of the central partitioning wall portion assures the insulation between the low-potential external iron core 4*a* and the high-potential secondary coil 2*a*.

When the central partitioning portion 51*a* of the case 5*a* which separates the central portion 40*a* of the external iron core 4*a* and the mold space portion 50*a* is molded thick enough to increase the dielectric strength, however, internal defects 100 such as nests and voids may be caused in the central partitioning wall portion 51*a* of the case 5*a*. When the internal defects are caused in the central partitioning wall portion 51*a* of the case 5*a*, a corona discharge may occur within the internal defects 100 upon operation and it will lead to reduce the insulation ability of the case 5*a* and finally to make the insulation breakdown.

On the contrary, when the central partitioning wall portion 51*a* of the case 5*a* is made thin in order to avoid the problem, the distance between the external iron core 4*a* and the secondary coil 2*a* becomes short and thus the strength of the electric field across the central partitioning wall portion 51*a* of the case 5*a* increases. As a result, a corona discharge may occur across the very small gap (not shown) of the boundary between the corner 48*a*, 49*a* of the external iron core 4*a* where the electric field strength is the highest, and the central partitioning wall portion 51*a* of the case 5*a*. When a corona discharge is caused thereat, the insulation ability of the case 5*a* is deteriorated as described above and finally the insulation may be broken down. The very small gap is created depending on the difference between the thermal expansion coefficients of the external iron core 4*a* and the case 5*a*.

SUMMARY OF THE INVENTION

In view of the foregoing, it is an object of this invention to provide an ignition coil assembly for internal combustion engines which does not easily cause any corona discharge and has high reliability.

According to a typical aspect of this invention, there is provided an ignition coil assembly for internal combustion engines, comprising a primary coil, a secondary coil coaxially disposed around the primary coil, an internal iron core inserted through the primary and secondary coils to form part of a closed magnetic path, an external iron core combined with the internal iron core to constitute the closed magnetic path and which has its central portion extended along the internal iron core with a constant distance kept therebetween, a resin-molded case which has a mold space portion containing the primary and secondary coils and the internal iron core, a withstand voltage air gap of a predetermined shape provided between the mold space portion and the central portion of the external iron core, and a central partitioning wall portion provided between the withstand voltage air gap and the mold space portion, and which resin-molded case is formed to be integral with the external iron core, and a mold resin portion which is formed by injecting a resin material into the mold space portion so as to surround and fix the primary and secondary coils and the internal iron core.

The thickness of the central partitioning wall portion is selected to be preferably, for example, in a range from the lower limit of about 0.5 mm from the molding point of view to the upper limit of about 3.5 mm from the viewpoint of nests, voids and so on to begin occurring, though the values depend on the conditions of molding the case.

The thickness of the withstand voltage air gap is selected to be preferably, for example, in a range from about 0.75 mm to 6 mm. In other words, when the thickness of the withstand voltage air gap is less than about 0.75 mm, the distance between the external iron core and the secondary coil becomes short, and thus the field strength in the withstand voltage air gap is increased. This may cause a corona discharge. Although it is better that the withstand voltage air gap can resist a higher voltage, excessive increase of the dielectric strength will uselessly make the assembly large-sized. As a result, the preferable thickness of the withstand voltage air gap should be in the above range in which at least a corona discharge can be prevented fully.

Since the electric field of interest here is most concentrated at around the corner of the external iron core, it is desired to provide the withstand voltage air gap at least between the corner of the external iron core and the secondary coil. In order to prevent the peculiar concentration of the field within the withstand voltage air gap, the thickness of the withstand voltage air gap should be made substantially constant and the inner surface of the withstand voltage air gap should be smooth.

The internal defects such as nests and voids which are easy to occur in the central partitioning wall portion of a thick wall of the prior art can be considered as a kind of air gap. These internal defects are irregular in the shape and size, thus causing the concentration of field which is not predictable, and hence a corona discharge.

In the ignition coil assembly for internal combustion engines of this invention, a withstand voltage air gap of a predetermined shape and a central partitioning wall portion which makes part of the case and separates the withstand voltage air gap from the mold space are provided between the mold space in which the secondary coil is placed and a mold resin is filled, and the external iron core. Therefore, part of the thickness of the central partitioning wall portion is, in a sense, replaced by the withstand voltage air gap so that the central partitioning wall portion is made thin enough not to cause within itself the nest and the void.

Thus, the electric field strength between the secondary coil and the external iron core is divided by the mold resin portion within the nold space, the central partitioning wall portion and the withstand voltage air gap.

DESCRIPTION OF THE PREFERRED EMBODIMENTS

EMBODIMENT 1

Figure 1:
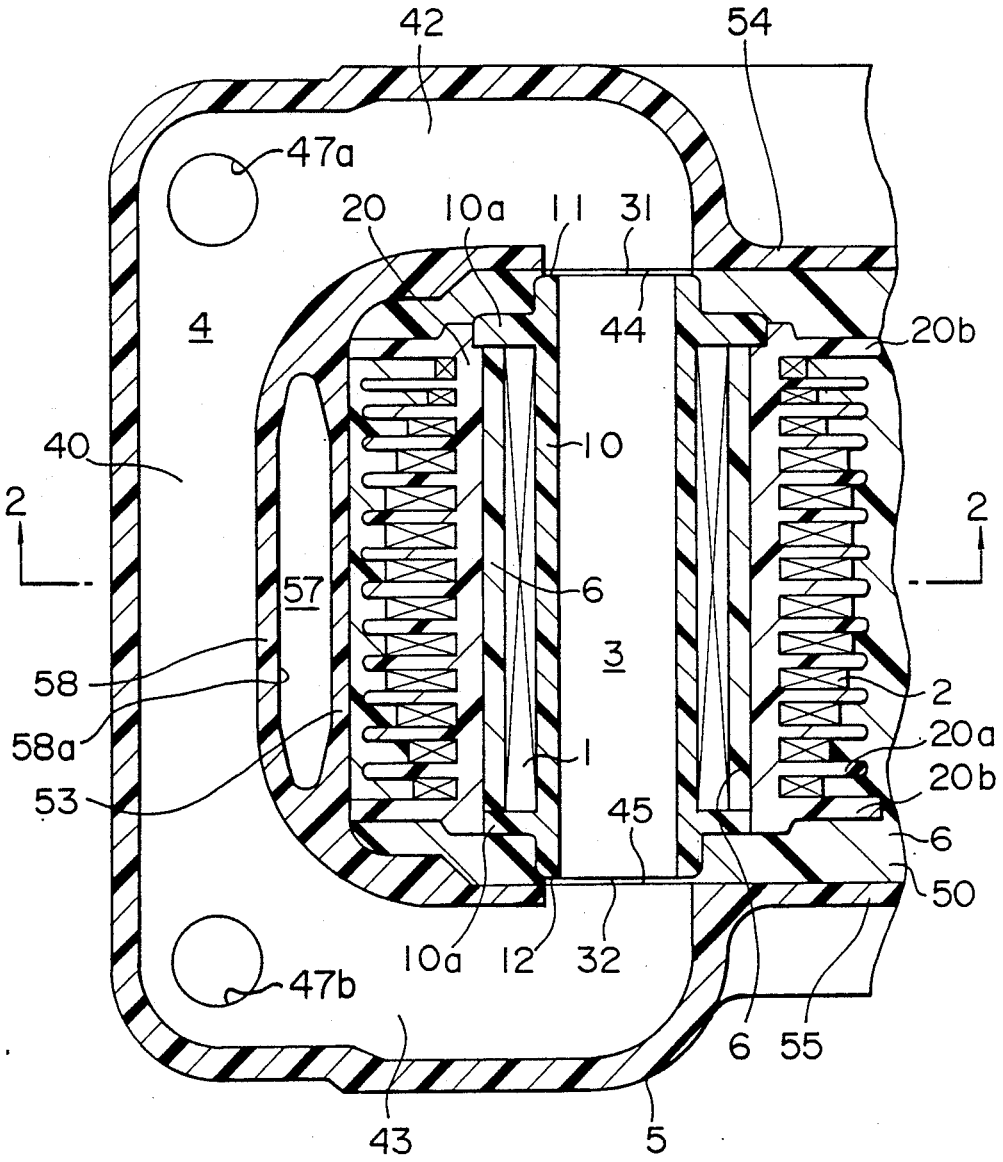
FIG. 1 is a partially cross-sectional plan view of a first embodiment of an ignition coil assembly for internal combustion engines of this invention.
Figure 2:
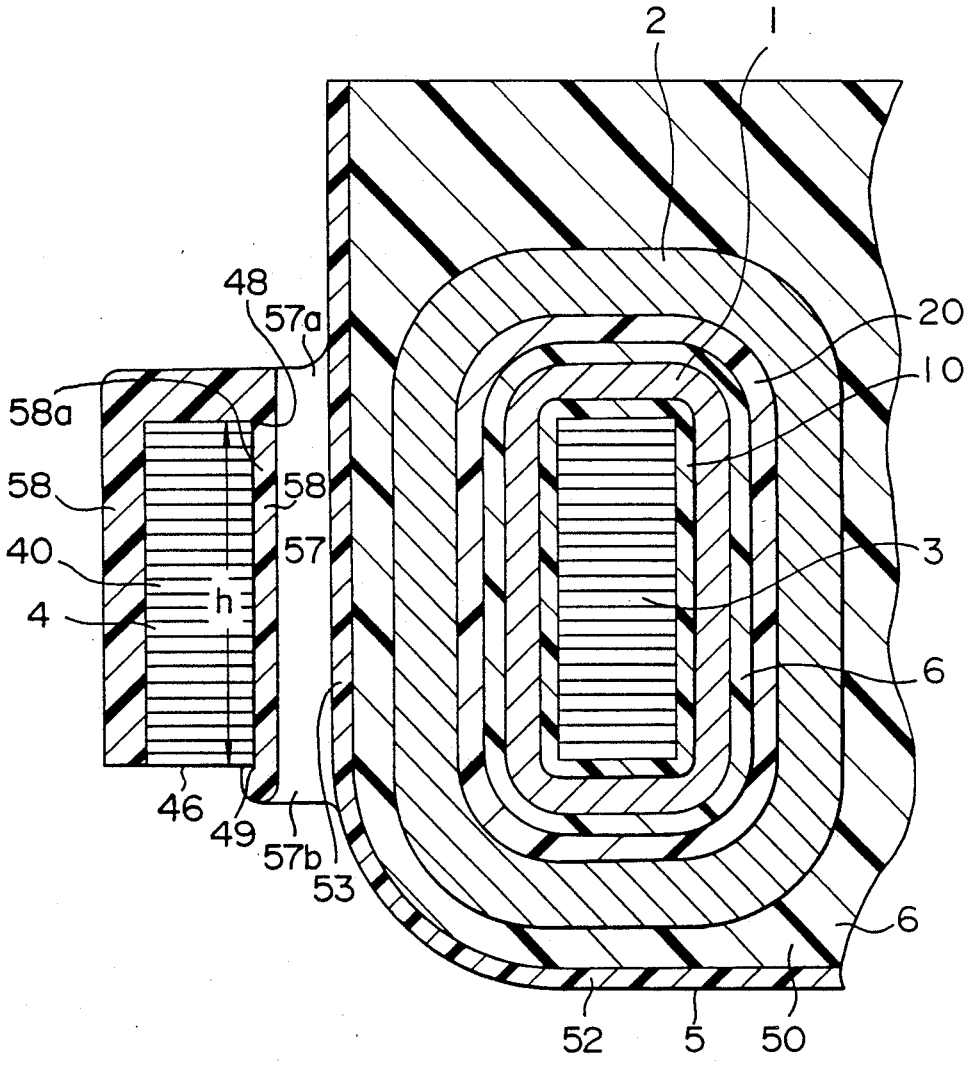
FIG. 2 is a partially cross-sectional front view taken along a line A—A' in FIG. 1.

One embodiment of an ignition coil assembly for internal combustion engines according to this invention will be described with reference to FIGS. 1 and 2. FIG. 1 is a partial cross-sectional plan view of the one embodiment, and FIG. 2 is a partial cross-sectional front view taken along a line A—A' in FIG. 1.

This ignition coil assembly for internal combustion engines comprises a primary coil 1, a secondary coil 2 coaxially disposed around the outside of the primary coil 1, an internal iron core 3 which is inserted through the primary and secondary coils 1 and 2, an external iron core 4 which is combined with the internal iron core 3 to constitute a closed magnetic path, a case 5 which is molded integral with the external iron core 4 and has a mold space 50, and a molded resin portion 6 which is formed by injecting a resin material into the mold space 50.

The internal iron core 3 is an I-shaped core of a cylindrical shape and of a rectangular shape in cross-section which is produced by stacking a great number of silicon steel laminas of the same shape. Around the outside of the internal iron core 3 is provided a primary spool 10 of a prism shape and of a predetermined wall thickness which is integrally molded with a thermoplastic resin. The internal iron core 3 has flux penetration surfaces 31, 32 at the opposite ends of the internal iron core 3. The flux penetration surfaces coincide with the ends 11, 12 of the primary spool 10, respectively. Ribs 10*a* are projected from near the ends 11, 12 of the primary spool 10. The primary coil 1 is wound around the outside of the primary spool 10. Also, the primary spool 10 is coaxially inserted in a secondary spool 20 substantially of a prism shape and the opposite ends of the inner peripheral surface of the secondary spool 20 are supported by the ribs 10*a* of the primary spool 10. The secondary spool 20 has a great number of ribs 20*a* with a predetermined spacing provided to project from its outer peripheral surface in the direction perpendicular to the axis of the core 3. Moreover, a large rib 20*b* is projected from each of the opposite ends of the outer peripheral surface of the secondary spool 20, and the secondary coil 2 is wound on the secondary spool 20.

The external iron core 4 is formed of a great number of silicon steel laminas of the same shape to be substantially U-shaped with its cross-section being rectangular. Moreover, this U-shaped external iron core has a central portion 40, and arms 42, 43 extending from both ends of the central portion 40 at right angles to the central portion 40. The arms 42, 43 have provided at their ends opposite magnetic flux penetration surfaces 44, 45 of a square shape, between which the internal iron core 3 is fitted so that the flux penetration surfaces 44, 45 of the external iron core 4, respectively oppose the flux penetration surfaces 31, 32 of the internal iron core 3 through a slight gap. The central portion 40 of the external iron core 4 has apertures 47*a*, 47*b* for insertion of clamping bolts bored at its opposite ends in the direction of stacking the silicon steel laminas.

The resin case 5 has a thin wall of a cup-like shape with its upper end opened and forms the mold space 50 of a substantially rectangular parallel-piped shape. In other words, the case 5 has a flat bottom portion 52 of a substantially rectangular shape, from the respective sides of which are integrally extended upwards a first side wall portion 53, a second side wall portion 54, a third side wall portion 55 and a fourth side wall portion (not shown). The second and third side wall portions 54, 55 are parallel and the first and fourth side wall portions 53 are parallel.

Moreover, slightly below the outer surface of the first side wall portion 53 is formed an external iron core cover 58 which is made of a resin (see FIG. 2). The wall thickness of the cover which covers the surface of the external iron core 4 is substantially constant. In this embodiment, the lower surface 46 of the external iron core 4 and the inner peripheral surface of the apertures 47*a*, 47*b* are not covered by this external iron core cover 58 but exposed to the external. The ends of the arms 42, 43 of the external iron core 4 reach the outsides of the second and third side wall portions 54, 55 of the case 5, and the flux penetration surfaces 44, 45 of the external iron core 4 are exposed to the mold space 50. In the mold space 50 are enclosed the primary coil 1, the secondary coil 2, the internal iron core 3, the primary spool 10 and the secondary spool 20. As described above, the flux penetration surfaces 44, 45 of the external iron core 4 are respectively opposed to the flux penetration surfaces 31, 32 of the internal iron core 3 through a slight gap.

The inside portion, 58*a* of the cover 58 of the case 5 which covers the central portion 40 of the external iron core 4 is opposed to the first side wall portion 53 of the case 5 through a withstand voltage air gap 57 about 2.5 mm wide. The upper and lower ends of the withstand voltage portion 57, as shown in FIG. 2, have openings 57*a*, 57*b* for communicating to the external space.

The molded resin portion 6 is formed by injecting a thermoplastic resin such as epoxy resin into the mold space 50 of the case 5 and fixes and protects the primary coil 1, the secondary coil 2 and the internal iron core 3 enclosed in the mold space 50. As described above, between the first side wall portion 53 of the case 5 and the external iron core 4 are located the inner side portion 58*a* of the external iron core cover 58 of which the wall thickness is about 1.5 mm, and the withstand voltage air gap 57 about 2.5 mm thick.

Upon operation of the ignition coil assembly for internal combustion engines, the external iron core 4 is grounded and the secondary coil 2 is at a high potential. The potential difference between the external iron core 4 and the secondary coil 2 is divided by the inner side portion 58*a* of the external iron core cover 58, the withstand voltage air gap 57, the first side wall portion 53 and the mold resin 6 in the mold space portion.

Thus, the strength of electric field between the external iron core 4 and the secondary coil 2 is decreased by the withstand voltage air gap 57. Therefore, even if the first side wall portion 53 of the case 5 and the inside portion 58*a* of the external iron core cover 58 thereof are decreased in the wall thickness, no corona discharge occurs between the external iron core 4 and the secondary coil 2. Particularly, the electric field flux between the external iron core 4 and the secondary coil 2 is normally collected at the corners 48, 49 of the external iron core 4, but in this embodiment, since the withstand voltage air gap 57 is larger than the total height h (see FIG. 2) of the external iron core 4, the electric field flux is fully prevented from being collected at around the corners 48, 49 of the external iron core 4.

Moreover, since the first side wall portion 53 of the case 5 and the wall of the external iron core cover 58 thereof are thin, internal defects such as nests and voids are difficult to occur.

EMBODIMENT 2

Figure 3:
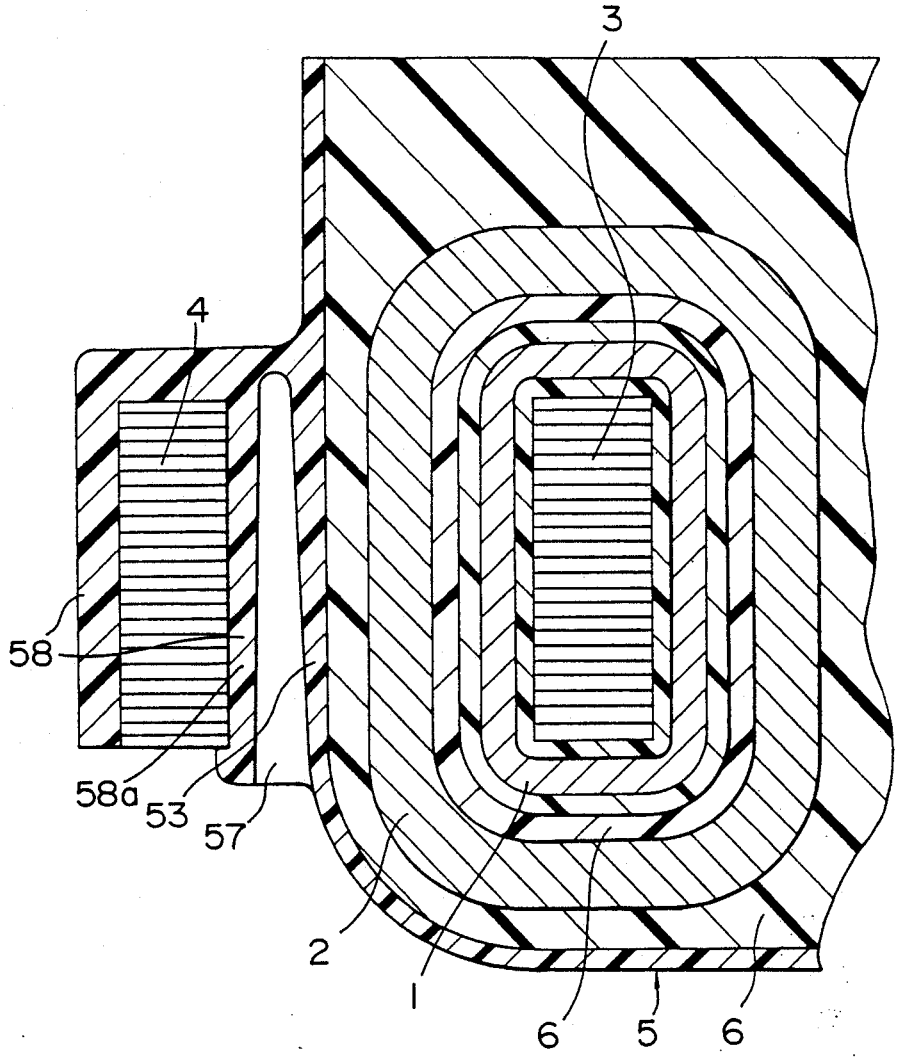
FIGS. 3, 4 and 5 are partially cross-sectional front views of other embodiments of an ignition coil assembly for internal combustion engines of this invention.

FIG. 3 is a partial cross-sectional front view of a second embodiment of an ignition coil assembly for internal combustion engines of this invention. In this figure, like elements corresponding to those in the first embodiment are identified by the same reference numerals.

This ignition coil assembly for internal combustion engines comprises the first coil 1, the second coil 2, the internal iron core 3, the external iron core 4, the case 5 and the molded resin portion 6. The second embodiment is different from the first embodiment only in the shape of part of the case 5.

In other words, in the case 5, the external iron core cover 58 and the first side wall portion 53 are connected at the upper end of the withstand voltage air gap 57, and as a result the withstand voltage air gap 57 and the external space are not communicated with each other at the upper side.

In this embodiment, since the withstand voltage air gap 57 is extended above the corner 48 of the external iron core 4, the electric field flux is fully prevented from being collected at near the corner 48 of the external iron core 4.

EMBODIMENT 3

Figure 4:
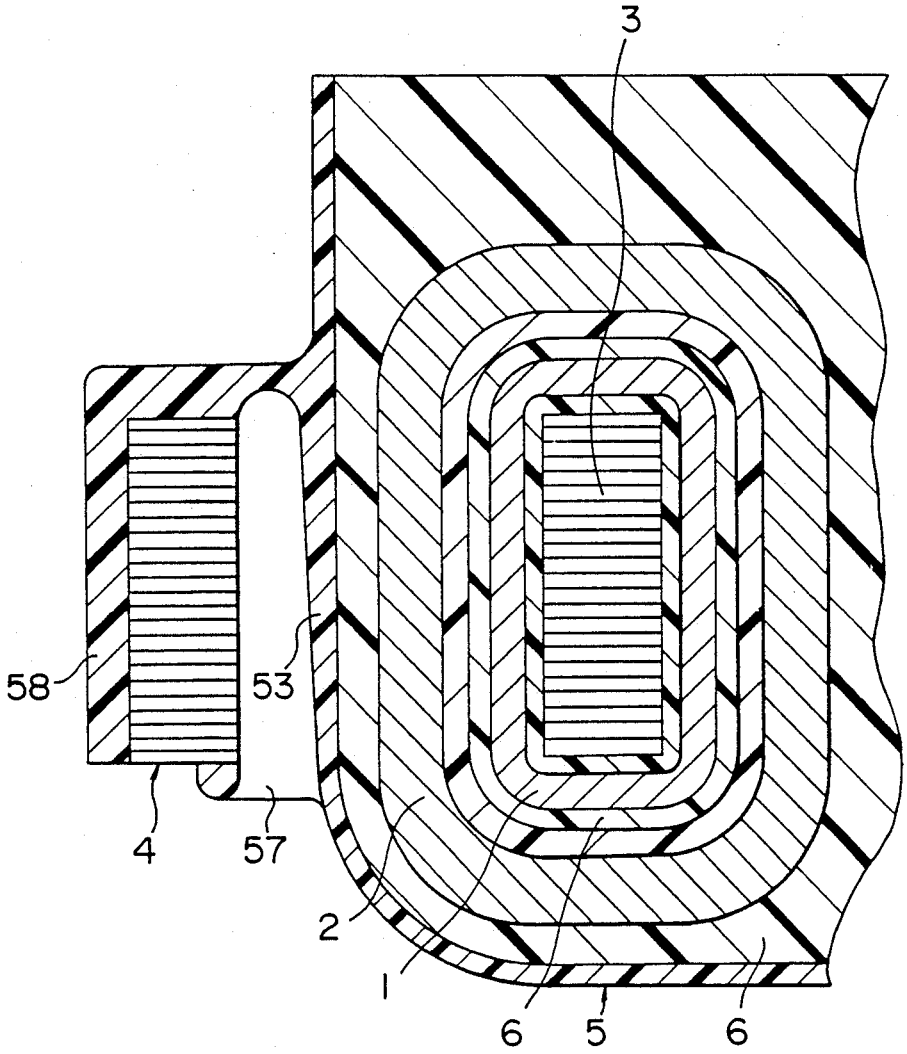

FIG. 4 is a partial cross-sectional front diagram of a third embodiment of an ignition coil assembly for internal combustion engines of this invention. In FIG. 4, like elements corresponding to those in the second embodiment are identified by the same reference numerals.

This ignition coil assembly for internal combustion engines comprises the first coil 1, the secondary coil 2, the internal iron core 3, the external iron core 4, the case 5 and the molded resin portion 6. The third embodiment is different from the second embodiment only in the shape of part of the case 5.

In other words, in this case 5, the inside portion 58*a* (see FIG. 3) of the external iron core cover 58 in the embodiment 2 is replaced by the withstand voltage air gap 57, so that the dielectric strength of the withstand voltage air gap 57 can be further increased.

EMBODIMENT 4

Figure 5:
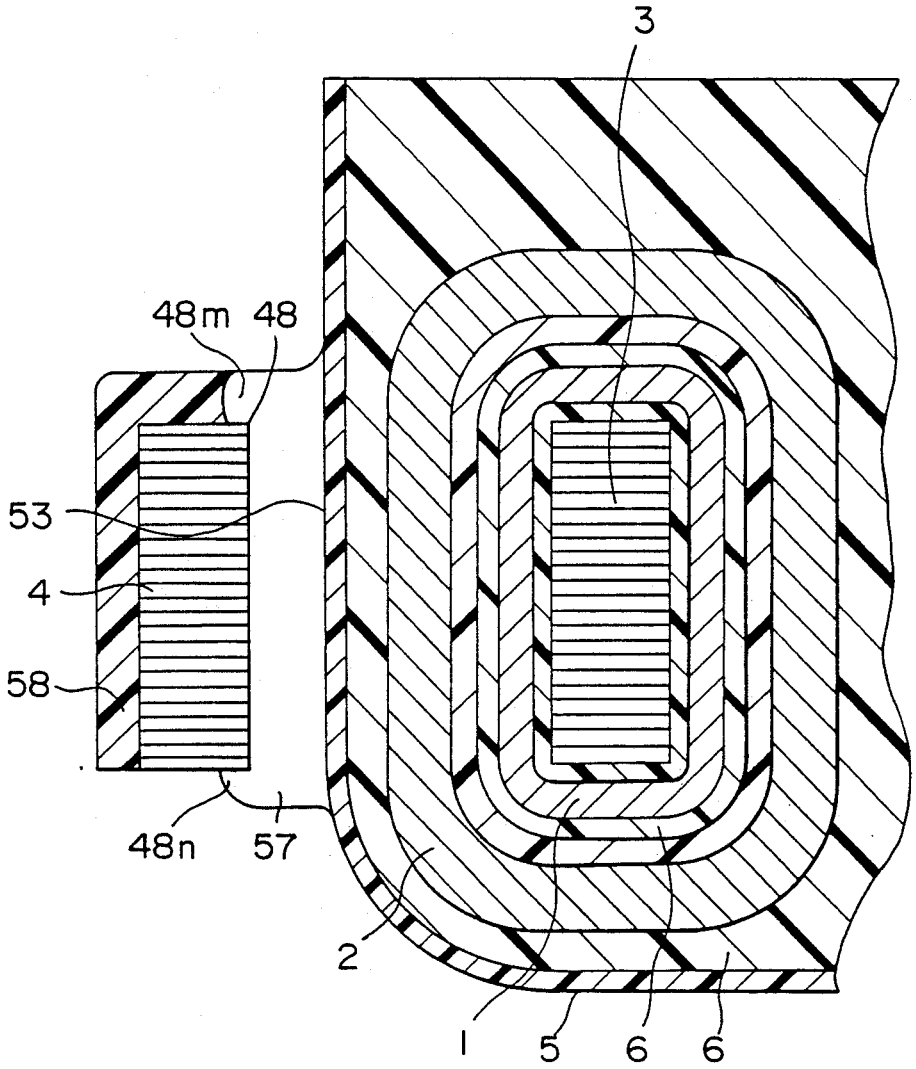
Figure 6:
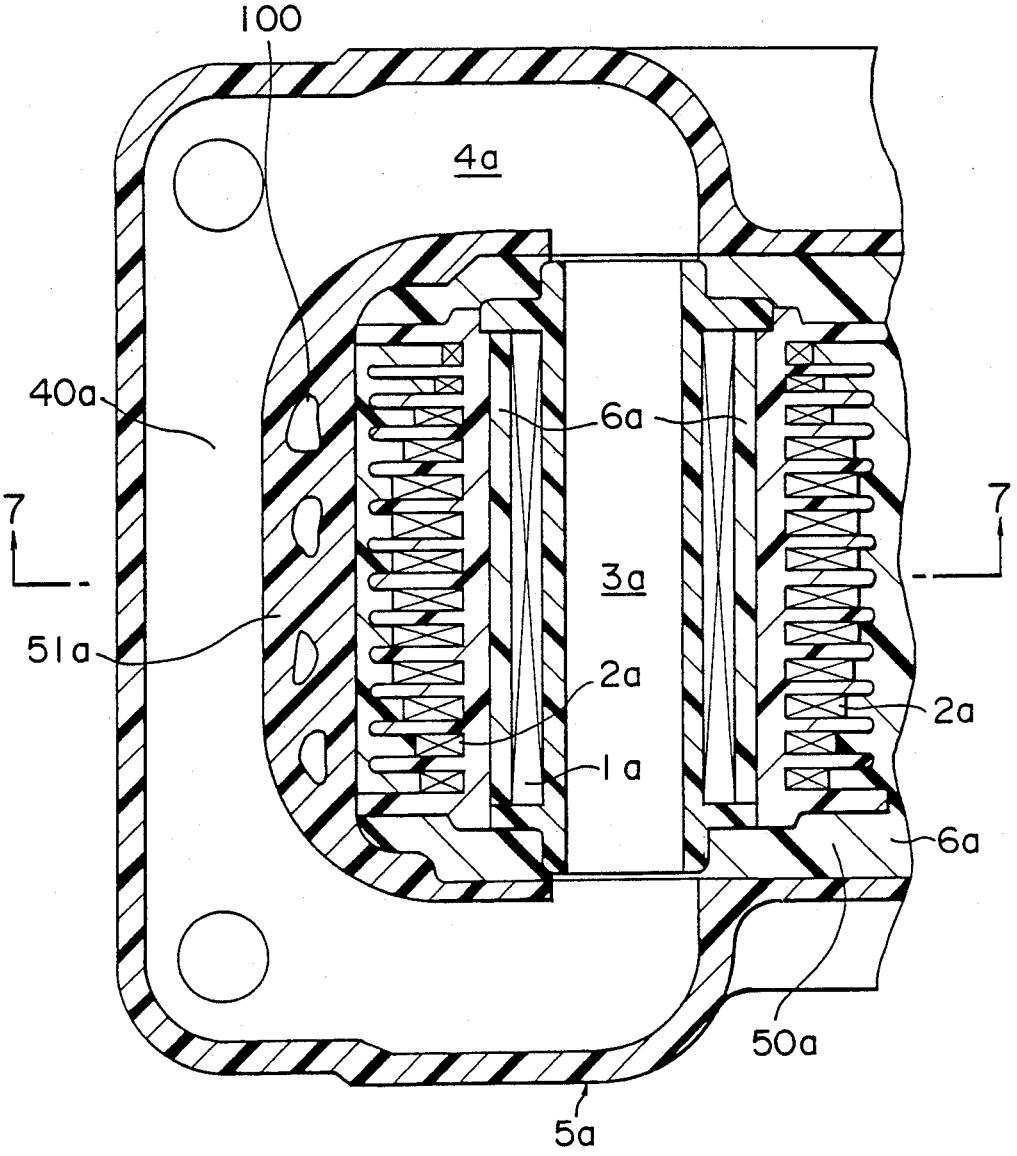
FIG. 6 PRIOR ART
FIG. 6 is a partially cross-sectional plan view of a conventional ignition coil assembly for internal combustion engines.
Figure 7:
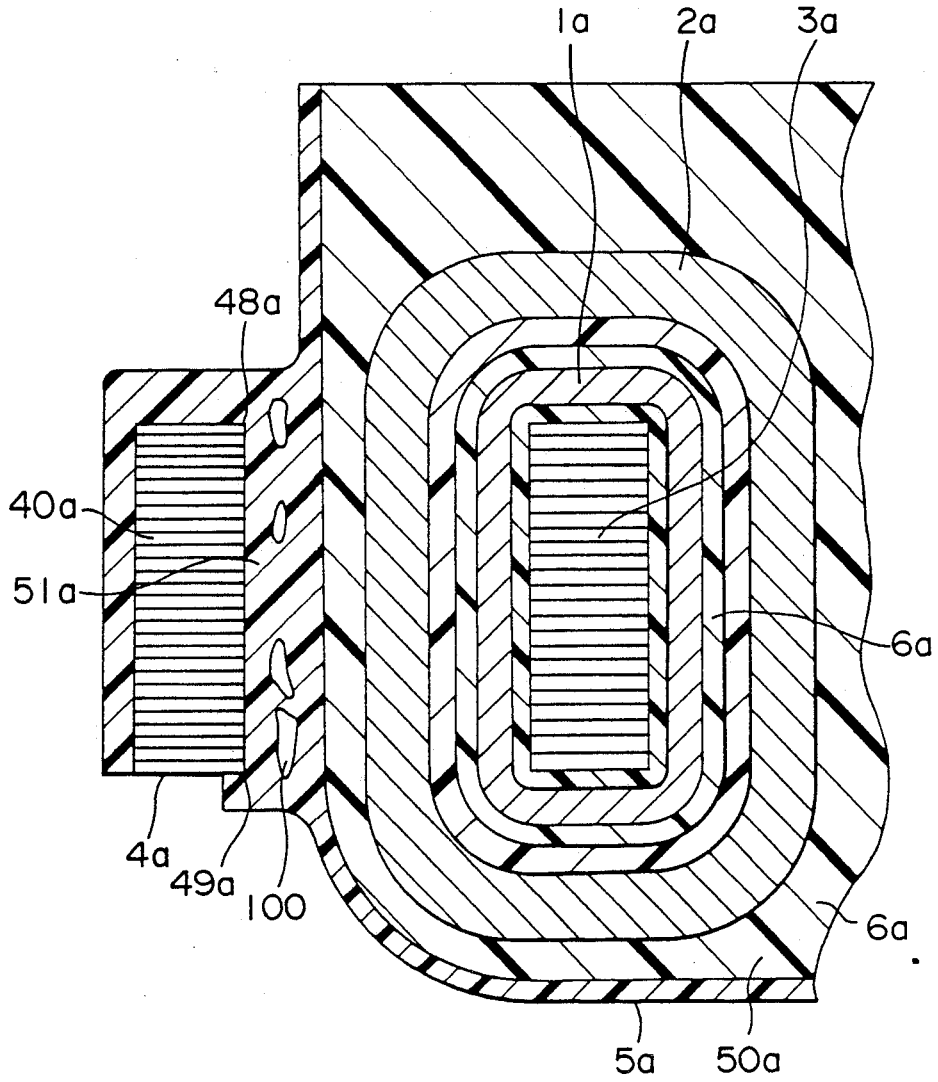
F I G. 7 PRIOR ART
FIG. 7 is a partially cross-sectional front view of the ignition coil assembly for internal combustion engines of FIG. 6.

FIG. 5 is a partially cross-sectional front view of a fourth embodiment of an ignition coil assembly for internal combustion engines of this invention. In FIG. 5, like elements corresponding to those in the first embodiment are identified by the same reference numerals.

This ignition coil assembly for internal combustion engines comprises the first coil 1, the secondary coil 2, the internal iron core 3, the external iron core 4, the case 5 and the molded resin portion 6. This embodiment is different from the embodiment 3 only in the shape of part of the case 5.

In this embodiment, the external iron core cover 58 has large recesses 48*m*, 48*n* provided at the positions close to the corners 48, 49 of the case 5, which prevent a discharge from being caused along the surface of the external iron core cover 58.

According to the ignition coil assembly for internal combustion engines of this invention, as described above, since the withstand voltage air gap of a predetermined shape is provided between the central partitioning wall portion of the case having the mold space portion in which the primary coil, the secondary coil and the internal iron core are enclosed, and the central portion of the external iron core close to this central partitioning wall portion, no corona discharge is difficult to occur, and thus the insulation ability of the case can be prevented from deteriorating even if the central partitioning wall portion of the case is decreased in its thickness.

Moreover, since the central partitioning wall portion of the case can be decreased in its thickness, internal defects such as nests and voids of irregular shapes through which a corona discharge is easy to occur can be suppressed from being caused.

We claim:

1. An ignition coil assembly for an internal combustion engine comprising:

a primary coil;

a secondary coil coaxially disposed around the outside of said primary coil;

an internal iron core inserted through said primary and secondary coils to make part of a closed magnetic path;

an external iron core combined with said internal iron core to constitute said magnetic path and which has its central portion extended along said internal iron core with a distance kept therebetween;

a case made of a resin which has a mold space in which said primary coil, said secondary coil and said internal iron core are enclosed, a withstand voltage air gap of a predetermined shape between said mold space and said central portion of said external iron core, and a central partitioning wall portion between said withstand voltage air gap and said mold space, said case being integrally formed with said external iron core; and a molded resin portion which is formed by injecting a resin material into said mold space so as to surround and fix said primary coil, said secondary coil and said internal iron core.

2. An ignition coil assembly for internal combustion engine according to claim 1, wherein said case has a side wall portion for making said mold space, part of said side wall portion being provided between said external iron core and said secondary coil, and an insulating resin cover portion for covering the surface of said external iron core to form said withstand voltage air gap between said part of said side wall portion and said cover.

3. An ignition coil assembly for internal combustion engine according to claim 2, wherein said air gap has opposite openings exposed to ambient space outside the coil.

4. An ignition coil assembly for internal combustion engine according to claim 3, wherein one opening of said air gap is closed by said side wall portion which is formed integral with said insulating resin cover portion.

5. An ignition coil assembly for internal combustion engine according to claim 2, wherein said insulating resin cover portion extended beyond end corners of said external iron core to prevent the concentration of electric field at near said corner.

6. An ignition coil assembly for internal combustion engine according to claim 1, wherein said case has a side wall portion for forming said mold space to be of a cup like shape, with said withstand voltage air gap being formed between part of said side wall portion and the coil-side surface of said external iron core, and an insulating resin cover portion for covering the other surfaces of said external iron core.

7. An ignition coil assembly for internal combustion engine according to claim 6, wherein said external iron core cover portion has recesses at the coil-side corner of the external iron core.

* * * * *